United States Patent [19]

Toyoda

[11] 4,389,864

[45] Jun. 28, 1983

[54] KEY HOLDER

[75] Inventor: Minoru Toyoda, Nagoya, Japan

[73] Assignee: Aisin Seiki Company, Limited, Kariya, Japan

[21] Appl. No.: 213,562

[22] Filed: Dec. 5, 1980

Related U.S. Application Data

[62] Division of Ser. No. 68,568, Aug. 22, 1979.

[30] Foreign Application Priority Data

| | | | |
|---|---|---|---|
| Sep. 8, 1978 | [JP] | Japan | 53-110845 |
| Feb. 6, 1979 | [JP] | Japan | 54-13025 |
| Feb. 6, 1979 | [JP] | Japan | 54-13026 |
| Feb. 6, 1979 | [JP] | Japan | 54-13027 |
| Feb. 6, 1979 | [JP] | Japan | 54-13028 |
| Feb. 6, 1979 | [JP] | Japan | 54-13029 |

[51] Int. Cl.[3] ..... A47G 29/10

[52] U.S. Cl. ..... 70/456 R

[58] Field of Search ..... 70/456–459; 24/3 K; 63/1, 19; 150/40; D3/61, 62

[56] References Cited

U.S. PATENT DOCUMENTS

| | | | |
|---|---|---|---|
| 2,047,331 | 7/1936 | Pollak | 70/456 R |
| 2,387,319 | 10/1945 | Evans | 70/456 R |
| 2,467,614 | 4/1949 | Duyn | 70/456 R |
| 2,517,500 | 8/1950 | McPherson | 70/456 R |
| 2,589,571 | 3/1952 | Queen | 70/456 R |
| 3,407,636 | 10/1968 | Kovacevic | 70/456 R |
| 4,048,824 | 9/1977 | Blackmon | 70/456 R |

*Primary Examiner*—Robert L. Wolfe

*Attorney, Agent, or Firm*—Oblon, Fisher, Spivak, McClelland & Maier

[57] ABSTRACT

A key holder which includes a body and a key pivotably mounted on the body and movable between an operating position in which the key is disposed outside of the body and a non-operating position in which the key is housed within the body. The key holder may also include a biasing member for maintaining the key at the operating position thereof or the non-operating position thereof and the key may include a stopper member disposed thereon which is engageable with the body to maintain the key at the non-operating position thereof.

8 Claims, 26 Drawing Figures

KEY HOLDER

This is a division of application Ser. No. 68,568, filed Aug. 22, 1979.

BACKGROUND OF THE INVENTION

Field of the Invention

This invention relates to a key holder and more particularly to a key holder of a pendant or tie-pin type for an automobile key or the like.

Generally, it is often inconvenient to carry keys for opening and closing vehicle doors and for starting vehicle engines. Furthermore, drivers sometimes forget their keys inside and outside vehicles, thus preventing driving of such vehicles.

SUMMARY OF THE INVENTION

Therefore, it is an object of the present invention to provide an improved key holder which is convenient to carry.

It is another object of the present invention to provide an improved key holder which is of a pendant type.

It is still another object of the present invention to provide an improved key holder which is of the tie-pin type.

It is still another object of the present invention to provide an improved key holder which is used as a spare key for vehicles to easily open the door even when the driver closes the door by means of a conventional keyless locking mechanism, thus leaving the key inside his vehicle.

It is a further object of the present invention to provide an improved key holder which is light in weight so as to be easy to carry.

It is still another object of the present invention to provide an improved key holder which is ornamental and aesthetically pleasing.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views, and wherein.

DETAILED DESCRIPTION OF THE PREFERRED EMBODIMENTS

Figure 1:
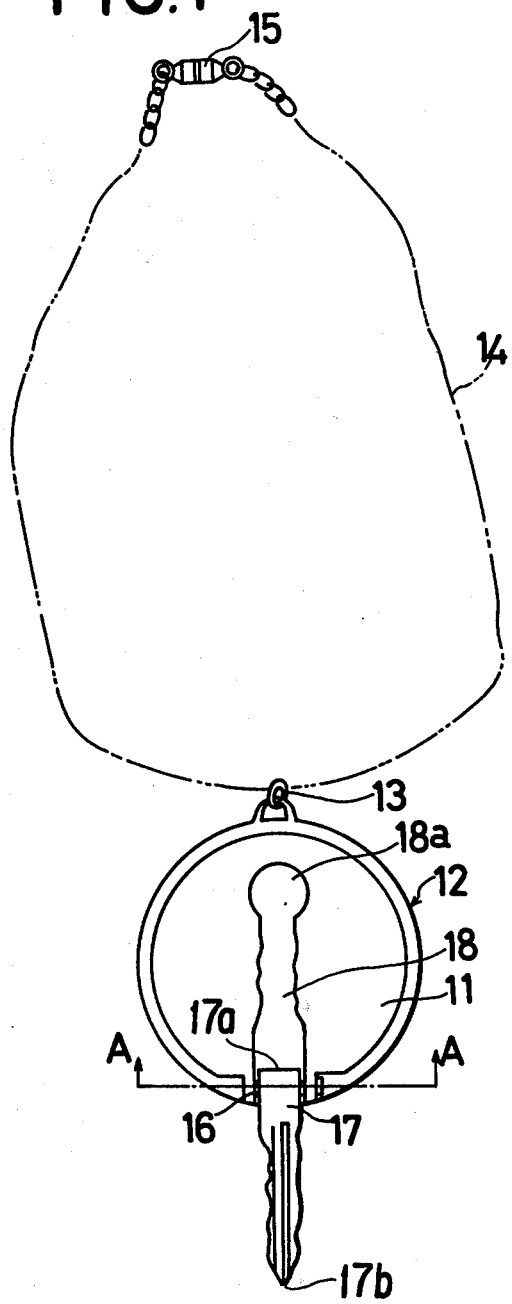
FIG. 1 is a front view of a key holder of the pendant type showing a first embodiment of the present invention.
Figure 2:
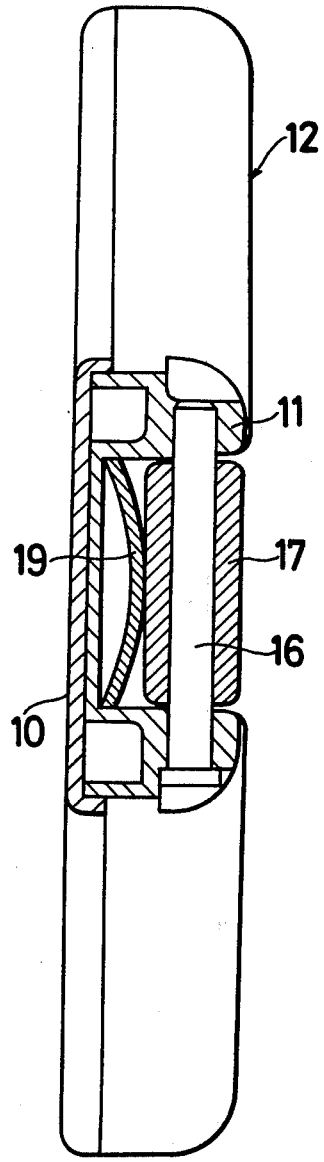
FIG. 2 is an enlarged cross sectional view taken along the line II—II of FIG. 1.

Referring to FIGS. 1 and 2 showing a first embodiment of the present invention, a pendant body or frame 12 of a key holder of a pendant type has first and second members 10 and 11, respectively, which are secured to each other. The body or frame 12 is connected by means of of a connection member 13 to a chain 14 to be placed around the neck of the driver as an ornament. The chain 14 is detachable by means of a chain connecting member 15.

At a lower portion of the second member 11 of the body 12, a key 17 is pivotably mounted along its width or dimension adjacent one end 17*a* of key 17 on a pin 16 which is securely fitted to the second member 11. Thus, the key 17 is rotatably positioned due to rotation about an axis transverse to the longitudinal axis of key 17 between its operating position as shown in FIG. 2 and its non-operating position where the key 17 is housed within a concave portion 18 formed on a surface of the second portion 11, the concave portion 18 being preferably formed corresponding to the configuration of the outer edge surface of the key 17.

A concave part 18*a* is successively formed with the concave portion 18 so that the driver can easily rotate the key 17 from the non-operating position to the operating position by positioning his or her finger partially within concave portion 18 and lifting the key 17 by a second end portion 17*b*. Suitable ornamental patterns or designs are formed on surfaces of the first and second member 10 and 11, whereby the key holder can be used as a pendant when the key 17 is in its non-operating position.

As will be apparent in FIG. 2, a biasing member such as leaf spring 19 is disposed within the pendant body 12 and is arranged between the key 17 and the concave portion 18 of the first member 10 for biasing the key 17 against the pin 16. Therefore, the key 17 is maintained in its proper position when in its non-operating position as well as in its operating position. The leaf spring 19 also has a snap action effect so that when the key 17 is moved over the center of rotational movement to its operating or non-operating position, the snap action effect of the spring 19 assists the effective movement of the key 17 to the desired positions. The pin 16 may be secured to the key 17 and may be rotatably supported on the second member 11 of the body 12 as shown in FIG. 2.

Figure 3:
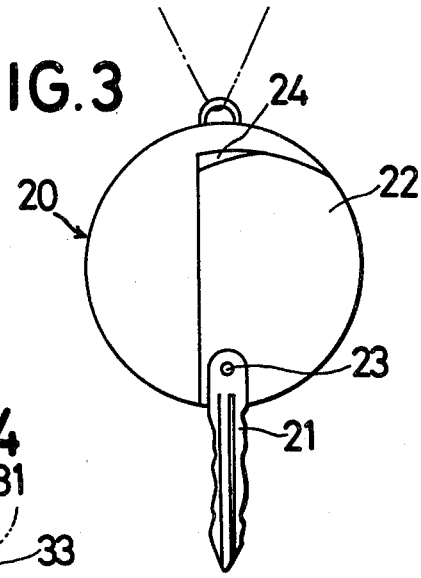
FIG. 3 is a view similar to FIG. 1 but showing a second embodiment of the present invention.

In FIG. 3 showing a second embodiment of the present invention, on one surface of a pendant body 20 which is formed as one body is formed a convace portion 22 to thereby allow horizontal and counter-clockwise rotatable movement of a key 21. A pivot pin 23 is securely fixed to the body 20 at the lower portion of the concave portion 22 and the key 21 is rotatably mounted on the pin 23. Thus, the key 21 is movable from the operating position as shown in FIG. 3 to the non-operating position by means of the rotatable movement of key 21 in the concave portion 22 in a horizontal and counter-clockwise direction. When the key 21 is moved in its non-operating position, the tip portion of the key 21 is pressingly engaged with a resilient member 24 which is securely arranged within or adjacent to the concave portion 22 so that the key 21 is maintained in its non-operating position.

If the pendant is worn in an up-side down manner, the key 21 in its non-operating position is thus maintained in its desired position by its weight per se and it is therefore not always necessary to provide for the resilient member 24.

Figure 4:
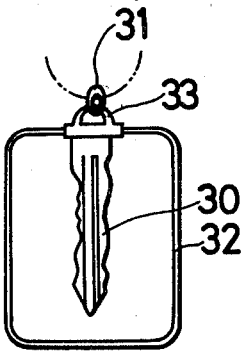
FIGS. 4 and 5 are views similar to FIG. 1 but showing third and fourth embodiments of the present invention, respectively.

In FIG. 4 showing a third embodiment of the present invention, a supporting member 33, which is secured to an upper part of a key 30, is connected to a connecting member 31 at one side thereof and supports a pendant frame or body 32 at the other side thereof. Thus, the key 30 per se as well as the frame 32 functions as an ornamental pattern or design when positioned in the same plane. The key 30 is maintained in its illustrated position due to its weight per se. In operating the key 30, the key 30 can be rotated with respect to the frame 32 outside the plane of the key so that the rotational moment of the key 30 upon insertion and subsequent rotation in a lock is effectively increased due to the operator's rotation of the frame 32.

Figure 5:
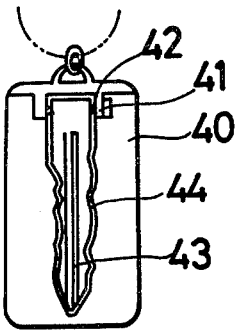

In FIG. 5 showing a fourth embodiment of the present invention, an upper portion 41 of a pendant body 40 is formed with a predetermined thickness and a pivot pin 42 is securely mounted on the thick upper portion 41. The body 40 has a hollowed-out or groove portion 44 which preferably corresponds to the configuration of key 43 and thus the key 43, pivotably mounted on the pin 42, is maintained in its non-operating position due to its weight per se. In operating the key 43, the key 43 may be pushed out from the hollowed portion 44.

Figure 6:
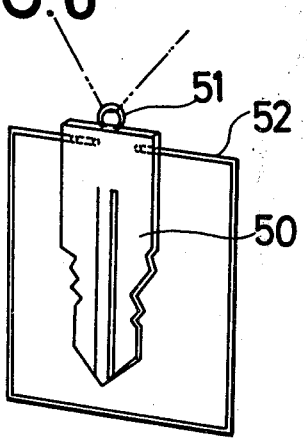
FIGS. 6 and 7 are enlarged views of key holders of a pendant type showing fifth and sixth embodiments of the present invention, respectively.

In FIG. 6 showing a fifth embodiment of the present invention, a key 50 is directly supported by a frame 52 and a connecting member 51 is secured to upper portion of the key 50. The functions of the key holder of a pendant type will be the same as those of FIG. 4 such that further explanation will be omitted.

Figure 7:
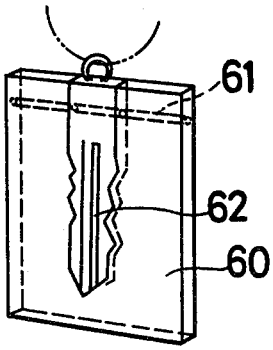

In FIG. 7 showing a sixth embodiment of the present invention, the thickness of a pendant body 60 is the same as that of a key 62. A pivot pin 61 is arranged and positioned inside the body 60. Thus the construction and the external appearance of the key holder is simplified. The functions of this key holder of a pendant type are the same as those of FIG. 5 so that further explanation will be omitted.

Figure 8:
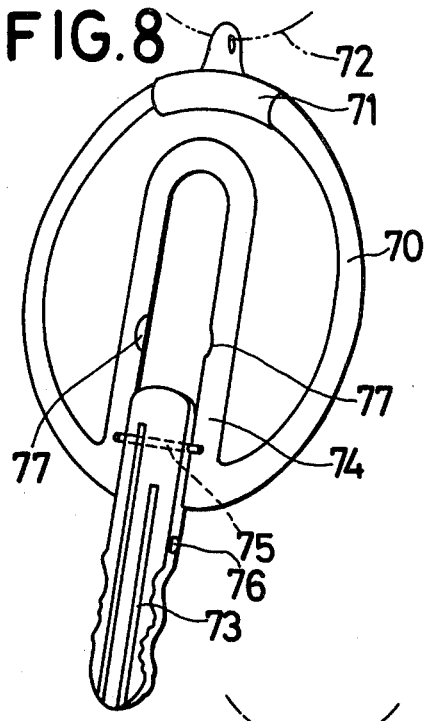
FIG. 8 is a enlarged view of a key holder of a pendant type the key of which is in its operating position, and which illustrates a seventh embodiment of the present invention.
Figure 9:
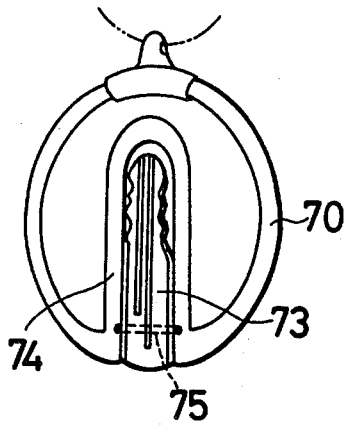
FIG. 9 is a frontal view of the key holder of FIG. 8, but showing the non-operating position of the key.

In FIGS. 8 and 9 showing a seventh embodiment of the present invention, a pendant body or frame 70 is connected to a chain 72 by means of a connecting member 72. The frame 70 is connected to a chain 72 by means of a connecting member 72. The frame 70 may be made of a suitable material such as silver. A key 73 is rotatably supported by means of a pivot pin 75 which is secured to a lower portion of a U-shaped supporting portion 74 of the frame 70. The key 73 has at each side thereof semi-circular projections 76, only one of which is shown in FIG. 8. The semi-circular projections 76 are pressingly engaged with corresponding concave portions 77, 77 on the supporting portions 74 when the key 73 is moved to its non-operating position as shown in FIG. 9 to thereby act as stoppers which maintain the key 73 in its non-operating position.

Resilient members (not shown) such as rubber may be secured on the concave portions 77, 77. It is thus apparent that the key 73 is rotatable about the pivot pin 75 and is movable between the operating portion as shown in FIG. 8 and the non-operating position as shown in FIG. 9.

Figure 10:
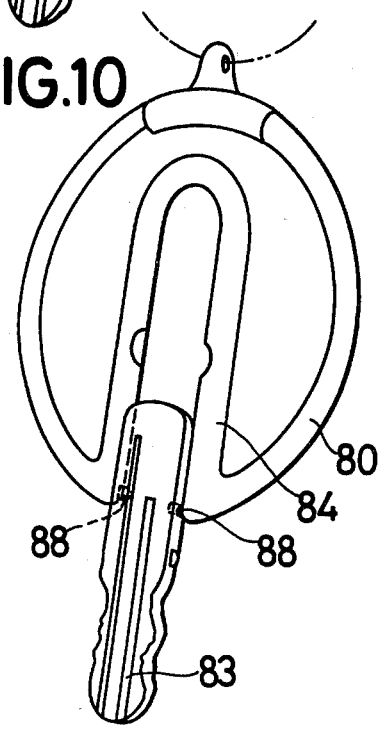
FIG. 10 is a view similar to that of FIG. 8, but showing an eighth embodiment of the present invention.

In FIG. 10 showing an eighth embodiment of the present invention, a supporting portion 84 of a frame or body 80 has projections 88, 88 which are inserted in corresponding holes provided in key 83, whereby the key 83 is rotatably supported on the frame 80. Other variations in construction of this key holder will be the same as those of FIGS. 8 and 9 so that further explanation thereof will be omitted.

Figure 11:
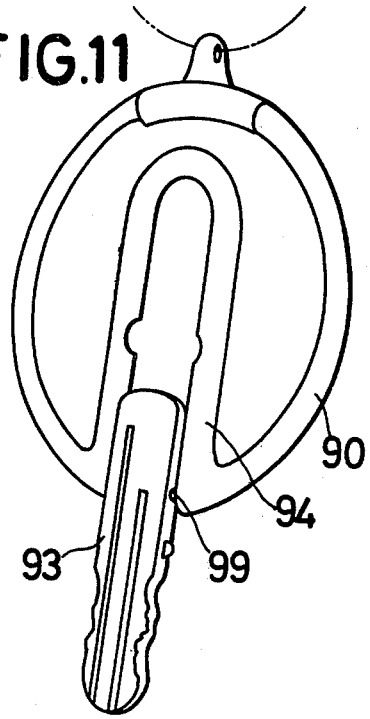
FIG. 11 is a view similar to FIG. 9, but showing a ninth embodiment of the present invention.

In FIG. 11 showing a ninth embodiment of the present invention, a key 93 is pressingly engaged with a pair of projections 99, 99 which are formed on a supporting portion 94 of a frame 90. Thus, the key 93 is maintained in its proper positions by engagement of the surface of the key 93 with the projections 99, 99. Other features of this key holder will be the same as those of FIGS. 8 and 9 so that further explanation will be omitted.

Figure 12:
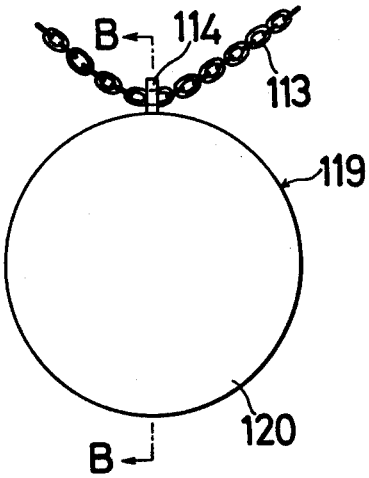
FIG. 12 is a frontal view of a key holder of a pendant type showing a tenth embodiment of the present invention.
Figure 13:
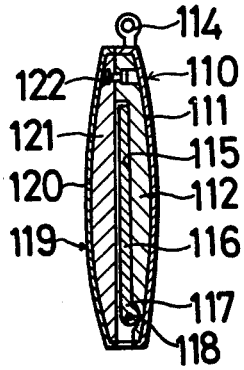
FIG. 13 is a cross-sectional view taken along the line XIII—XIII of FIG. 12.
Figure 14:
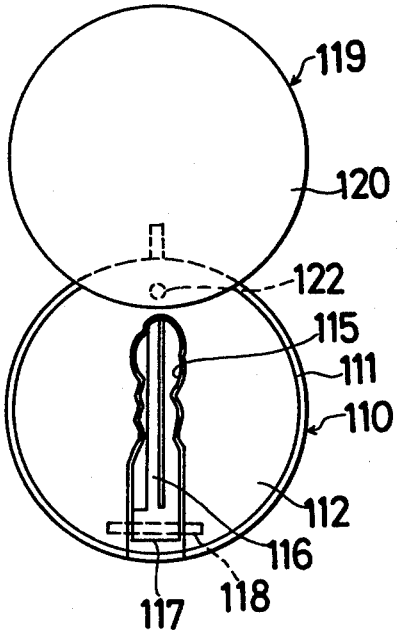
FIG. 14 is a view similar to that of FIG. 12, but showing a pendant cover which is rotated with respect to a pendant body.
Figure 15:
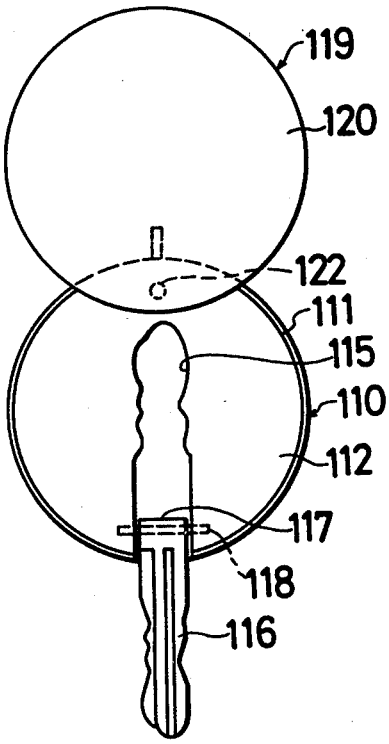
FIG. 15 is a view similar to FIG. 12, but showing an operating position of the key.

In FIGS. 12 to 15 showing a tenth embodiment of the present invention, a pendant body or frame 110 has an outside member 111 of circular disc shape and an inside member 112 which is securely positioned within the outside member 111 and is similarly shaped. An ornamental pattern or design can be provided on the surface of the outside member 111. The outer periphery of the outside member 111 has an eye portion 114 through which a chain 113 passes. The interior of the inside member 112 forms an elongated concave portion 115 within which a key 116 is housed. At the lower portion of the concave portion 115, a base portion 117 of the key 116 is pivotably supported by means of a pivot pin 118 which is secured to the inside member 112. Thus, the key 116 is rotatable between the non-operating position as shown in FIGS. 12 and 13 and the operating position as shown in FIG. 15.

Pendant cover 119 includes an outside member 120 on the surface of which an ornamental pattern or design is placed and a second inside member 121 which is secured within the outside member 120. Inside member 121 is pivotably mounted on the second inside member 112 of the pendant body 110 by means of a pivot pin 122. Thus, the pendant cover 119 rotates about the pin 122 on the pendant body 110 and is positioned above the pendant body 110 as shown in FIGS. 12 and 13 when the key 116 is in non-operating position. Therefore, when the key 116 is in such non-operating position, the key 116 is not visible from outside the pendant cover 119. It is apparent that the pendant body 110 and the pendant cover 119 may be formed as one body, respectively, and the configurations thereof may be modified as desired.

Figure 16:
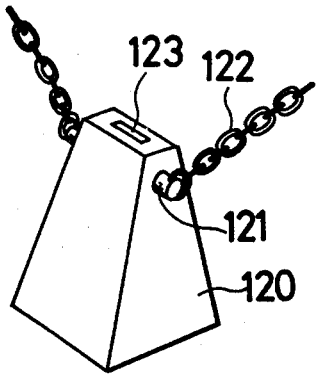
FIG. 16 is an enlarged view of a key holder of a pendant type showing an eleventh embodiment of the present invention.
Figure 17:
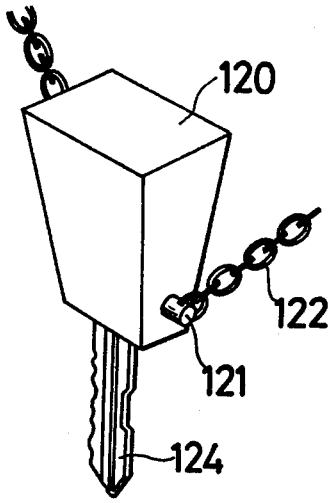
FIG. 17 is a view similar to FIG. 16, but showing the key holder as being turned upside-down.
Figure 18:
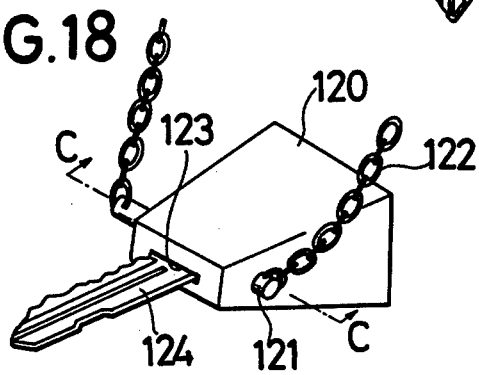
FIG. 18 is a view similar to FIG. 16, but showing an operating position of the key.

In FIGS. 16 to 19 showing an eleventh embodiment of the present invention, a pendant body or frame 120 which is of a square-based pyramid or hexahedron configuration has a slidable pole 121 near its upper portion which upper portion is cut off as illustrated. A chain 122 is connected to both ends of the pole 121 and thus, the pendant body 120 is not easily turned upside-down when the key holder is placed around the neck of a driver or key operator. The upper surface of the pendant body 120 has a square hole 123 formed therein in which a sheath 125 is secured. A key 124 is slidably housed within the sheath 125. The key 124, while usually housed within the sheath 125, as shown in FIG. 16, can project outwardly of the pendant body 120 due to its weight or mass per se when the body 120 is turned upside-down as shown in FIG. 17. The projecting range of the key 124 is limited by engagement between the sheath 125 and the key 124 and thus the key 124 is prevented from falling.

Figure 19:
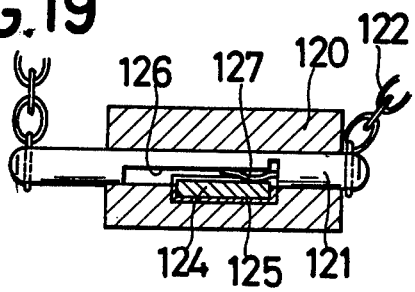
FIG. 19 is a cross-sectional view taken along the line XIX—XIX of FIG. 18.

As illustrated in FIG. 19, the pole 121 has a recess 126 formed therein which confronts the side surface of the key 124 through a recess in the sheath 125. A leaf spring 127 is positioned within the recess 126 and is movable in and out between the key 124 and the pole 121 in response to sliding movement of the pole 121. In other words, one end of the spring 127 is secured to the pole 121, and the spring 127 is squeezed between the key 124 and the pole 121 to thereby limit sliding movement of the key 124 when the pole 121 is moved to its position shown in FIGS. 18 and 19. Thus, the key 124 is not retracted within the body 120 in the operating position.

The configuration of the pendant body 120 may be changed, and the pendant body 120 may be formed with transparent and/or non-transparent material. If the body 120 is made with transparent material, it is desired that the ornamental pattern or design be placed on the surface of the sheath 125. The projection on the pole 121 may engage with a recess formed in the key so that the key may not be retracted into the body 120 in operating the key.

Figure 20:
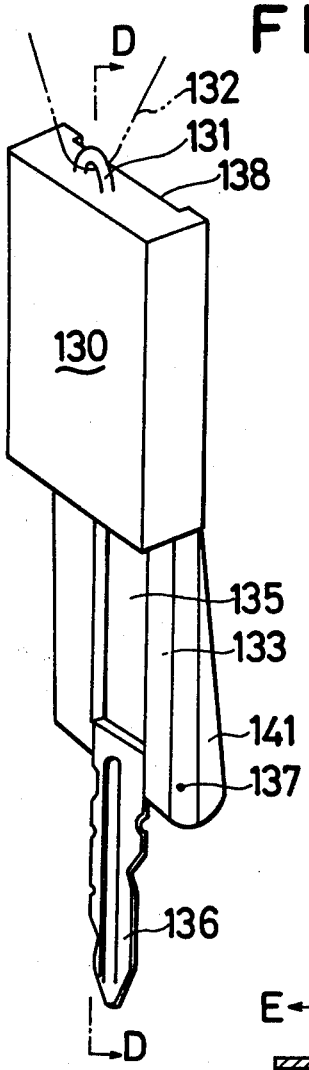
FIG. 20 is an enlarged view of a key holder of a pendant type showing a twelfth embodiment of the present invention.
Figure 22:
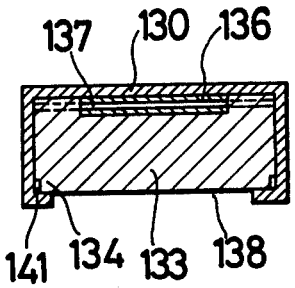
FIG. 22 is a cross-sectional view taken along the line XXII—XXII of FIG. 21.
Figure 21:
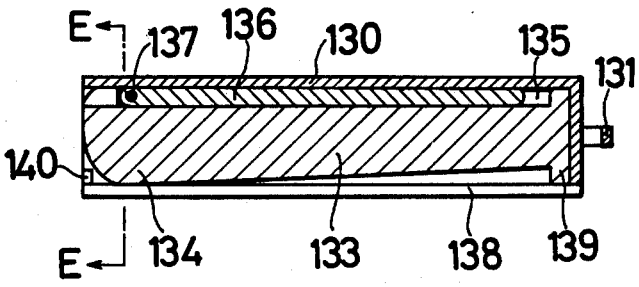
FIG. 21 is a cross-sectional view taken along the line XXI—XXI of FIG. 20.

In FIGS. 20 to 22 showing a twelfth embodiment of the present invention, a pendant body 130 includes a connecting member 131 through which a chain 132 passes. A slider 133 is slidably positioned within the body 130. When the slider 133 is housed within the body 130 as shown in FIG. 21, a portion 134 of the slider 133 contacts with the lower surface of the body 130, whereby the slider 133 is prevented from falling out of the body 130. The slider 133 has at the upper surface thereof an elongated groove 135 in which a key 136 is housed. One end of the key 136 is pivotally supported by a pin 137 which is secured to the slider 133.

The rear surface of the pendant body 130 has a recess 138 formed therein. Thus, the driver can manually rotate the key 136 into its operating or non-operating position by release of the engagement between the portion 134 of the slider 133 and the body 130 or by completion of the engagement between the portion 134 of the slider 133 and the body 130. More particularly, in order to displace the key 136 into its operating position, the slider 133 is manually displaced to the left in FIG. 21 through the recess 138 to thereby release the engagement between the portion 134 of the slider 133 and the body 130. Under this condition, a leg 139 provided on the lower portion of the slider 133 contacts with inwardly bent portions or flanges 140 of the body 130, whereby the slider 133 is prevented from falling out of the body 130 and the key 136 is usable. Grooves 141 are formed in the outside of the slider 133 to thereby allow sliding movement of the slider 133 through the bent portions 140 of the body 130.

The slider 133 may be formed of metal or resinous material. The pin 137 and the key 136 may be formed as one body and the slider 133 may include a hole in which the pin is rotatably received. When the slider 13 is housed within the body 130, the key 136 is jammed between the slider 133 and the body 130.

In operating the key 136, the key 136 is manually rotated from the groove 135 of the slider 133. If a spring is provided between the pin 137 and the key 136 for continuously biasing the key 136 into its operating position or in a counter-clockwise direction in FIG. 21, the key 136 can be automatically rotated into its operating position as shown in FIG. 20 when the slider 133 is displaced into the position shown in FIG. 20. In returning the key 136 to the groove 135, the key 136 may be manually rotated in a clockwise direction against the biasing force of the spring.

Figure 23:
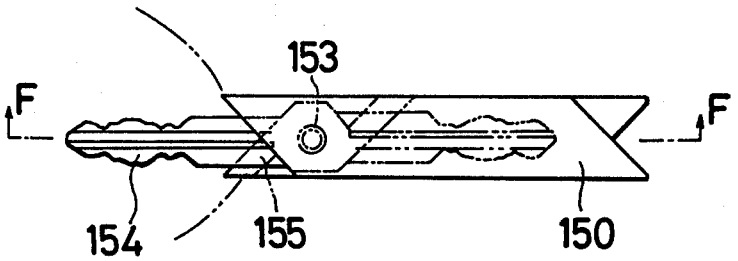
FIG. 23 is a plan view of a key holder of tie-pin type showing a thirteenth embodiment of the present invention.
Figure 24:
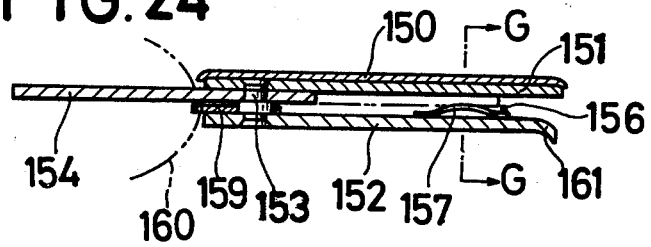
FIG. 24 is a cross-sectional view taken along the line XXIV—XXIV of FIG. 23.
Figure 25:
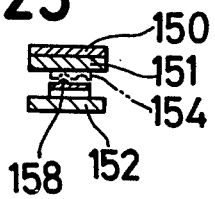
FIG. 25 is a cross-sectional view taken along the line XXV—XXV of FIG. 24.

In FIGS. 23 to 25 showing a thirteenth embodiment of the present invention, a key holder may normally be used as a tie-pin. A key 154 is rotatably mounted on a pivot pin 153 between first and second members 151 and 152. An ornamental pattern or design may be placed on surface 150 of the first member 151. The key 154 is thus movable between the operating position as shown by solid lines in FIGS. 23 and 24 and the non-operating position as shown by chain lines in FIGS. 23 and 24.

One end 155 of the key 154 projects outwardly from the first member 151 even when the key 154 is in its non-operating position, and thus, the one end 155 of the key 154 acts as a hook portion when it is desired that the key 154 be displaced into its operating position. One end 156 of a leaf spring 157 is secured to the second member 152 and the key 154 in its non-operating position is biased toward the first member 151 by the spring 157 to thereby be maintained in its proper position. The leaf spring 157 has a convex portion 158 which corresponds to a concave portion formed in the key 154 so that the key 154 is more assuredly maintained in its proper position. A connecting member 159 is mounted on the second member 152 by means of the pin 153 and has a hole through which a chain 160 passes.

Since a necktie may be secured between the key 154 and the spring 157, the first and second members 151 and 152, and more particularly, the key holder may thus be used as a tie pin. The other end of the spring 157 is free and the second member 152 has a guide portion 161 so that a tie could be held therein quite easily. Furthermore, if one of the first and second members 151 and 152 are formed of resilient material, the tie is more easily held.

The above key holder may be hung around the neck of the driver by means of the chain 160. In this case, the key holder may function as a pendant and both ends of the spring 157 may be secured to second member 152.

Figure 26:
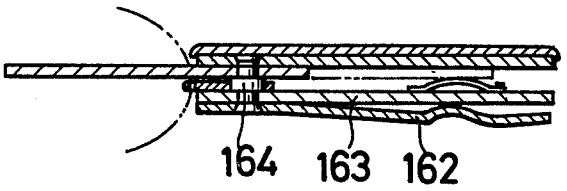
FIG. 26 is a view similar to FIG. 24, but showing a fourteenth embodiment of the present invention.

In FIG. 26 showing a fourteenth embodiment of the present invention, a resilient supporting member 162 is mounted on the lower surface of the second member 163 by means of a pin 164. Thus, the tie can be placed between the second member 163 and the supporting member 162. Other constructions will be the same as those of the previous embodiment of FIGS. 23 to 25 so that further explanations thereof will be omitted.

Obviously, many modifications and variations of the present invention are possible in light of the above teachings. It is therefore understood that within the scope of the appended claims the invention may be practiced otherwise than as specifically described herein.

What is claimed as new and desired to be secured by Letters Patent of the United States is:

1. A pendant type key holder comprising:

a body including a concave portion having the configuration of said key, said concave portion including a serrated portion conforming to the serrations of said key, said concave portion further including a depressed circular portion having a depth greater than said concave portion, said depressed portion being located at the part of said concave portion corresponding to the tip of said key;

said key pivotably mounted on said body and movable between an operating position in which the key is disposed outside said body and a non-operating position in which the key is housed within said concave portion; and biasing means connected to said body for maintaining said key at the operating position thereof or the non-operating position thereof, whereby said key forms an ornamental portion of said key holder when in said non-operating position.

2. A pendant type key holder as set forth in claim 1, said biasing means comprising a spring member disposed within said concave portion.

3. A pendant type key holder as set forth in claim 1 wherein said biasing means are within said concave portion.

4. A pendant type key holder as set forth in claim 1, said key having a first end portion and further comprising a pin member mounted to said body within said concave portion and connected to said key adjacent said first end portion for pivotably mounting said key to said body across the width dimension of said key.

5. A pendant type key holder as set forth in claim 4, said biasing means being positioned in said concave portion between said body and said first end portion of said key.

6. A pendant type key holder as set forth in claim 1, said body further comprising a first and second member and means for connecting said first member to said second member, said concave portion being formed in said second member.

7. A pendant type key holder as set forth in claim 1, further comprising:

a connecting member mounted on said body; and a chain member cooperatively associated with said connecting member such that said pendant type key holder can be placed around the neck of the wearer in the form of a pendant ornament.

8. A pendant type key holder as set forth in claim 5, said biasing means comprising a leaf spring.

* * * * *

UNITED STATES PATENT AND TRADEMARK OFFICE

CERTIFICATE OF CORRECTION

PATENT NO. : 4,389,864

DATED : June 28, 1983

INVENTOR(S) : MINORU TOYODA

It is certified that error appears in the above-identified patent and that said Letters Patent is hereby corrected as shown below:

In column 3, line 23, delete "convace" and insert therefor--concave--;

In column 4, lines 16 and 17, delete "The frame 70 is connected to a chain 72 by means of a connecting member 72.".

Signed and Sealed this

*Thirteenth* Day of *September 1983*

[SEAL]

*Attest:*

GERALD J. MOSSINGHOFF

*Attesting Officer*

*Commissioner of Patents and Trademarks*